United States Patent [19]

Pallesen

[11] 4,137,431

[45] Jan. 30, 1979

[54] CABLE CONNECTOR FOR HEARING AIDS

[76] Inventor: Hugo B. Pallesen, Bremerholm 26, DK-1069, Copenhagen, Denmark

[21] Appl. No.: 852,375

[22] Filed: Nov. 17, 1977

[30] Foreign Application Priority Data

Nov. 19, 1976 [DK] Denmark ..... 5211/76

[51] Int. Cl.[2] ..... H04R 25/00

[52] U.S. Cl. ..... 179/107 H; 179/107 S

[58] Field of Search ..... 179/107 R, 107 BC, 107 FD, 179/107 H, 107 S, 107 E, 1 PC, 186

*Primary Examiner*—George G. Stellar

*Attorney, Agent, or Firm*—Nolte & Nolte

[57] ABSTRACT

Cable connector for the connection of an electrical cable to a near the ear places hearing aid, f.inst. hearing spectacles or a hearing aid placed behind the ear and comprising terminals secured to the cable, said terminals coming into contact with corresponding terminals in the housing during the connecting action, the cable connector comprising a terminal holder secured to the cable, said cable connector being arranged to engage around and come into snap engagement with the hearing aid, pairs of corresponding terminals being mounted with one terminal in the housing of the hearing aid and one terminal in said cable connector secured to said cable in such a way as to be placed opposite each other by connecting operation and to press resiliently against each other.

6 Claims, 3 Drawing Figures

FIG. 1
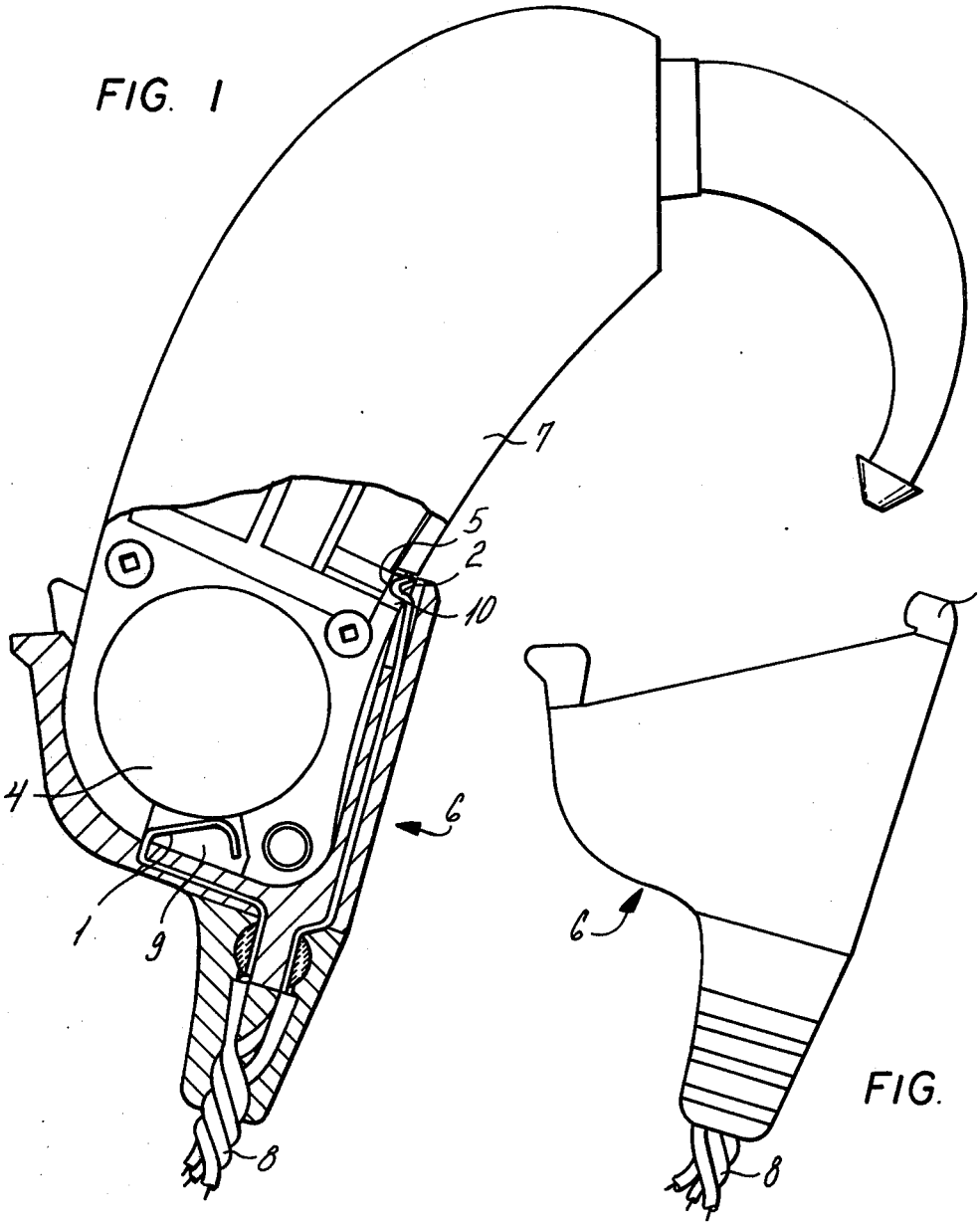
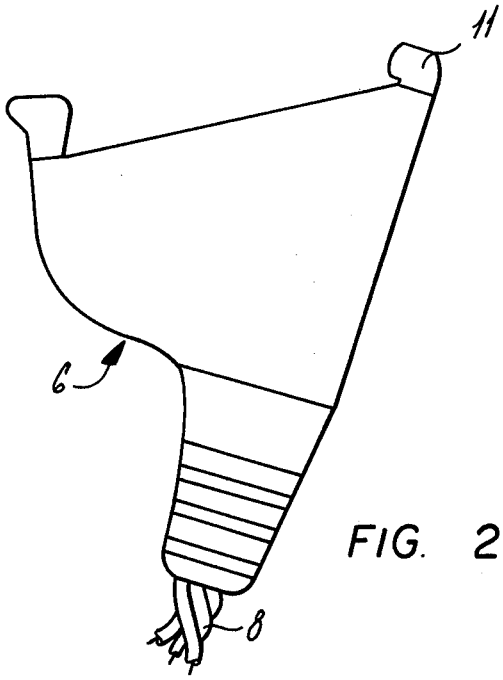
FIG. 2
FIG. 3
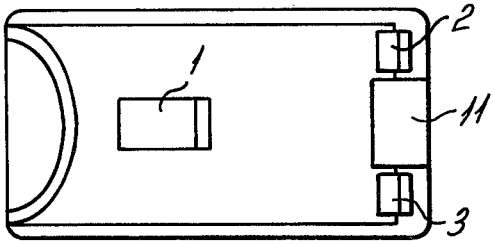

CABLE CONNECTOR FOR HEARING AIDS

The invention concerns a cable connector for connection of an electrical cable to a near the ear placed hearing aid, f.inst. hearing spectacles or a behind the ear placed apparatus, and to terminals mounted on a cable, which terminals through the connector come into contact with corresponding terminals in the hearing aid.

Such hearing aids usually form complete untis with microphone, amplifier and sound receiver. For special purposes it is, however, often required to connect the hearing aid to another microphone, f.inst. for telephone reception, TV or radio reception or to special hearing aids. Hitherto cable connectors have been used with a terminal holder with two or more legs which through a cable is connected to the foreign microphone and with corresponding terminal bushings in the hearing aid in which the legs of the connector are introduced at the establishing of the connection. Hearing aids of the said kind being very small per se the cable connectors become correspondingly small and it can then be difficult and often impossible to introduce the extremely small legs in the extremely small bushings in a near the ear placed hearing aid.

It is an object of the invention to provide a cable connector of the said kind with which it is possible to connect a near the ear placed hearing aid of usual dimensions to a foreign microphone etc. without having to remove the hearing aid from its place near the ear, and this is obtained according to the invention when the cable connector contains a, to a cable attached terminal holder arranged to grasp and snap lock the hearing aid, pairs of said terminals being mounted with a terminal in the housing of the hearing aid and a terminal in the terminal holder attached to the cable in such a way that they by the snap lock action are placed opposite each other and pressed resiliently against each other.

In this way it is obtained that the housing will act as the cable connector male part which thus gets the biggest possible dimensions in relation to the size of the housing. Contrary to earlier known connectors of the said kind where small legs had to be introduced by the connection into small holes with few millimeters mutual distance in the end of the housing a cable connector according to the invention can without difficulty be connected using a hearing of usual small dimensions placed near the ear.

According to a special feature of the invention the terminal holder may be a cap with thin walls of mainly the same form as the corresponding part of the housing. After connection the terminal holder will fit the housing without changing its dimensions any essential way.

According to another special feature of the invention the terminals mounted in the terminal holder may be composed of contact springs arranged to fit into recesses in the housing and press against corresponding terminals in the housing in form of contact surfaces in the bottom of the recesses. During the connecting action the contact springs can yield resiliently without impeding the connection or making it difficult and, when in correct position they can snap into the corresponding recesses in the housing and press against the contact surfaces in the bottom of the recesses with a predetermined pressure.

According to a further special feature of the invention the recesses may be situated in the end surface of the housing and on one or more of the sides of the housing. In this way an advantageous distribution of the strains from the contact pressure can be obtained in such a way as to enhance the securing of the terminal holder on the housing.

In the following the invention will be described in more details with reference to the drawing, where FIG. 1 shows a hearing aid with a cable connector according to the invention and with terminal holder shown in section with the cover of the hearing aid partly removed, FIG. 2 the terminal holder shown in elevation, and FIG. 3 a plan view of the terminal holder.

On the drawing is shown a hearing aid 7 of usual form for placing behind the ear. On the side situated behind the hearing aid by the use is mounted a terminal holder 6, in which is embedded three contact springs 1,2,3 each being connected by soldering to a conductor in a cable 8, the end which also being embedded in the cable.

The upper part of the terminal holder securing the springs 1, 2, 3 is moulded of rigid plastic to form a cap with thin walls which after assembling of the cable connector resiliently grips the end of the housing 7, a projection 11 on the terminal holder engaging with snap lock action into a recess 10 on the side of the housing at the end of the connecting action to secure the terminal holder 6.

The contact spring 1 engages after the connection into a recess 9 on the end of the housing 7 and presses at the bottom of the recess against the side of a battery 4 acting as housing terminal. The other two terminals 2 and 3 engager after the connection into the recess 10 and press against two terminals in the bottom of the recess, one of said terminals 5 being shown in FIG. 1.

The terminal holder shown on the drawing is formed as a cap surrounding the end of the housing of the hearing aid. It will be clear that sometimes it may be advantageous instead to construct the terminal holder with two or more fingers able to engage around the housing, f.inst. to avoid hollow spaces in the terminal holder, in which dirt can be collected. On the drawing the terminals are shown as contact springs pressing against contact surfaces in the bottoms of recesses in the housing. Such recesses being subjected to be filled with dirt during the use, it will often be preferable to make the contacts self cleaning, f.inst. with sharp edges making a scraping movement in relation to the contact surfaces in the recesses. It is also possible to protect the recesses against clogging, f.inst. by provision of elastic lips, opening during the connecting operation, or instead to place the contact surfaces on the terminal holder and provide the housing with contact pins or springs projecting through elastic lips by the connecting operation and pressing against the contact surfaces.

In the shown embodiment of the invention the cable is permanently secured to the cap 6. Instead the cable 8 and the cap can be releasably interconnected, f.inst. by a plug and jack connection, so as to make it possible to exchange the cable.

What I claim is:

1. Cable connector for the connection of an electrical cable 8 to a near the ear places hearing aid, f.inst. hearing spectacles or a hearing aid placed behind the ear and comprising terminals secured to the cable, said terminals coming into contact with corresponding terminals in the housing during the connecting action, characterized in that the cable connector comprises a terminal holder secured to the cable, said cable connector being arranged to engage around and come into snap engagement with the hearing aid, pairs of corresponding terminals being mounted with one terminal in the housing of the hearing aid and one terminal in said cable connector secured to said cable in such a way as to be placed opposite each other by the connecting operation and to press resiliently against each other.

2. Cable connector according to claim 1, characterized in that the terminals in the terminal holder are contact springs, arranged to engage into recesses in the housing and press against as contact surfaces arranged terminals in the housing in the bottom of the recesses.

3. Cable connector according to claim 2 characterized in that one or more of the recesses are arranged at the end surface of the housing and one or more on the side of the housing.

4. Cable connector according to claim 1, characterized in that the cable connector is constituted of a cap with thin walls and mainly of the same form as the corresponding part of the housing.

5. Cable connector according to claim 4, characterized in that the terminals in the terminal holder are contact springs, arranged to engage into recesses in the housing and press against as contact surfaces arranged terminals in the housing in the bottom of the recesses.

6. Cable connector according to claim 5, characterized in that one or more of the recesses are arranged at the end surface of the housing and one or more on the side of the housing.

* * * * *